US010196943B2

(12) United States Patent
Cecur

(10) Patent No.: US 10,196,943 B2
(45) **Date of Patent: *Feb. 5, 2019**

(54) VALVE TRAIN ASSEMBLY

(71) Applicant: EATON INTELLIGENT POWER LIMITED, Dublin (IE)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 66 days.

This patent is subject to a terminal disclaimer.

(21) Appl. No.: 15/265,878

(22) Filed: Sep. 15, 2016

(65) Prior Publication Data

US 2017/0002698 A1 Jan. 5, 2017

Related U.S. Application Data

(63) Continuation of application No. 14/395,500, filed as application No. PCT/EP2013/058208 on Apr. 19, 2013, now Pat. No. 9,470,116.

(30) Foreign Application Priority Data

Apr. 19, 2012 (EP) ..... 12164703

(51) Int. Cl.

| | |
|---|---|
| ***F01L 1/18*** | (2006.01) |
| ***F01L 13/00*** | (2006.01) |
| ***F01L 1/04*** | (2006.01) |
| ***F01L 1/34*** | (2006.01) |
| ***F02M 26/01*** | (2016.01) |

(Continued)

(52) U.S. Cl.

CPC ..... *F01L 1/185* (2013.01); *F01L 1/04* (2013.01); *F01L 1/047* (2013.01); *F01L 1/18* (2013.01); *F01L 1/34* (2013.01); *F01L 13/0021* (2013.01); *F01L 13/0036* (2013.01); *F01L 13/0047* (2013.01); *F02D 13/0207* (2013.01); *F02D 13/0273* (2013.01); *F02M 26/01* (2016.02); *F01L 2001/186* (2013.01); *F01L 2001/467* (2013.01)

(58) Field of Classification Search

CPC ..... F01L 1/18; F01L 1/04; F01L 1/185; F01L 13/0021; F01L 13/0036

USPC ..... 123/90.16, 90.39, 90.44

See application file for complete search history.

(56) References Cited

U.S. PATENT DOCUMENTS

| | | | |
|---|---|---|---|
| 4,151,817 | A | 5/1979 | Mueller |
| 5,524,580 | A | 6/1996 | Muir |

(Continued)

FOREIGN PATENT DOCUMENTS

| | | | |
|---|---|---|---|
| DE | 2753197 | A1 | 6/1978 |
| DE | 102010011826 | A1 | 12/2011 |

(Continued)

*Primary Examiner* — Ching Chang

(74) *Attorney, Agent, or Firm* — Leydig, Voit & Mayer, Ltd.

(57) ABSTRACT

A valve train assembly includes a rocker arm, comprising: a first roller, configured to engage a first rotatable cam surface; and a further roller, configured to engage a further rotatable cam surface, wherein at least part of the rocker arm can be pivoted by at least the first rotatable cam surface to move a valve to cause a first valve event, and wherein at least part of the rocker arm can be pivoted by the further rotatable cam surface to move the valve to cause a second valve event.

12 Claims, 8 Drawing Sheets

(51) Int. Cl.

| | |
|---|---|
| ***F01L 1/047*** | (2006.01) |
| ***F02D 13/02*** | (2006.01) |
| *F01L 1/46* | (2006.01) |

(56) References Cited

U.S. PATENT DOCUMENTS

| | | | | |
|---|---|---|---|---|
| 5,529,033 | A | 6/1996 | Hampton | |
| 6,314,928 | B1 | 11/2001 | Baraszu et al. | |
| 6,439,179 | B2 | 8/2002 | Hendriksma et al. | |
| 6,732,685 | B2 | 5/2004 | Leman | |
| 7,730,861 | B2 | 6/2010 | Ng | |
| 9,470,116 | B2 * | 10/2016 | Cecur | F01L 1/185 123/90.39 |
| 2001/0023675 | A1 | 9/2001 | Lee et al. | |
| 2001/0027765 | A1 | 10/2001 | Hendriksma et al. | |
| 2001/0035140 | A1 | 11/2001 | Fernandez et al. | |
| 2006/0144356 | A1 | 7/2006 | Sellnau et al. | |
| 2007/0101958 | A1 | 5/2007 | Seitz | |
| 2008/0127917 | A1 | 6/2008 | Riley et al. | |
| 2008/0223324 | A1 | 9/2008 | Ng | |
| 2010/0043737 | A1 | 2/2010 | Elnick et al. | |
| 2010/0236507 | A1 | 9/2010 | Kang et al. | |
| 2010/0275864 | A1 | 11/2010 | Gemein et al. | |
| 2011/0005483 | A1 | 1/2011 | Manther et al. | |
| 2011/0197842 | A1 | 8/2011 | Manther et al. | |
| 2011/0226208 | A1 | 9/2011 | Zurface et al. | |

FOREIGN PATENT DOCUMENTS

| | | | |
|---|---|---|---|
| EP | 0735249 | A1 | 10/1996 |
| EP | 0767296 | A1 | 4/1997 |
| EP | 1149988 | A2 | 10/2001 |
| EP | 1338760 | A2 | 8/2003 |
| EP | 1561013 | A1 | 8/2005 |
| EP | 1785595 | A1 | 5/2007 |
| WO | WO 2011156684 | A2 | 12/2011 |

* cited by examiner

VALVE TRAIN ASSEMBLY

CROSS-REFERENCE TO RELATED APPLICATIONS

This application is a continuation of U.S. application Ser. No. 14/395,500, filed Oct. 20, 2014, which is a U.S. National Stage application under 35 U.S.C. § 371 of International Application No. PCT/EP2013/058208, filed on Apr. 19, 2013, claiming benefit to European Patent Application No. 12164703.6, filed on Apr. 19, 2012, all of which applications are hereby incorporated by reference herein in their entireties. The International Application was published in English on Oct. 24, 2013, as WO 2013/156610 A1 under PCT Article 21(2).

FIELD

The present invention relates to a valve train assembly having a rocker arm for control of valve actuation.

BACKGROUND

Dual lift rocker arms for control of valve actuation by alternating between at least two or more modes of operation are known. Such rocker arms typically involve multiple bodies, such as an inner arm and an outer arm, that are latched together to provide one mode of operation and are unlatched, and hence can pivot with respect to each other, to provide a second mode of operation. The so called Type II valve train (i.e. end pivot rocker arm, overhead cam) is the most commonly used valve train in both modern petrol and diesel internal combustion engines. Dual lift rocker arms for this type of valve train often use a three lobe camshaft wherein a first and a second of the lobes control one type of valve lift and the third of the lobes control another type of valve lift. Typically in such arrangements, the outer arm of the dual lift rocker arm is provide with a pair of arcuate metal pads each for making a sliding contact with a respective one of the first and second of the lobes, and the inner arm is provided with a roller for making a rolling contact with the third of the lobes. The manufacturing of such rocker arms involves producing the sliding contacts by investment casting, attaching them by soldering and coating them with a low-friction coating. This is an involved and relatively expensive process.

It would be desirable to produce a rocker arm that can be manufactured more easily and cost effectively.

SUMMARY

An aspect of the invention provides a valve train assembly, comprising: a rocker arm comprising: a first body supporting a first axle on which is mounted a first roller configured to engage a first rotatable cam surface, wherein at least part of the rocker arm can be pivoted by at least the first rotatable cam surface to move a valve to cause a first valve event; a second body supporting a second axle on which is mounted a further roller configured to engage a further rotatable cam surface, wherein at least part of the rocker arm can be pivoted by the further rotatable cam surface to move the valve to cause a second valve event, wherein one of the first and second bodies is pivotally mounted with respect to the other of the first and second bodies; wherein the rocker arm is configurable in a first mode of operation in which one of the first and second valve events occurs and a second mode of operation in which both the first and second valve events occur or the other of the first and second valve events occurs; wherein the rocker arm further comprises a latch configured to latch and unlatch the first and second bodies together and wherein which of the first and second modes the rocker arm is configured in depends upon whether the first and second bodies are latched or are unlatched; wherein the latch comprises a latch member moveable between a latched position whereby the latch member latches the first and second bodies together and an unlatched position in which the first and second bodies are unlatched; and wherein the valve train assembly further comprises a latching actuator configured to move the latch member between the latched position and the unlatched position, wherein the latching actuator comprises a rotatable shaft attached to a biasing member, wherein rotating the rotatable shaft from a first position to a second position causes the biasing member to move the latch member between the latched position and the unlatched position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the invention provides a rocker arm comprising: a first roller for engaging a first rotatable cam surface whereby at least part of the rocker arm can be pivoted by at least the first rotatable cam surface to move a valve to cause a first valve event; and a further roller for engaging a further rotatable cam surface whereby at least part of the rocker arm can be pivoted by the further rotatable cam surface to move the valve to cause a second valve event which is different from the first valve event.

Figure 1:
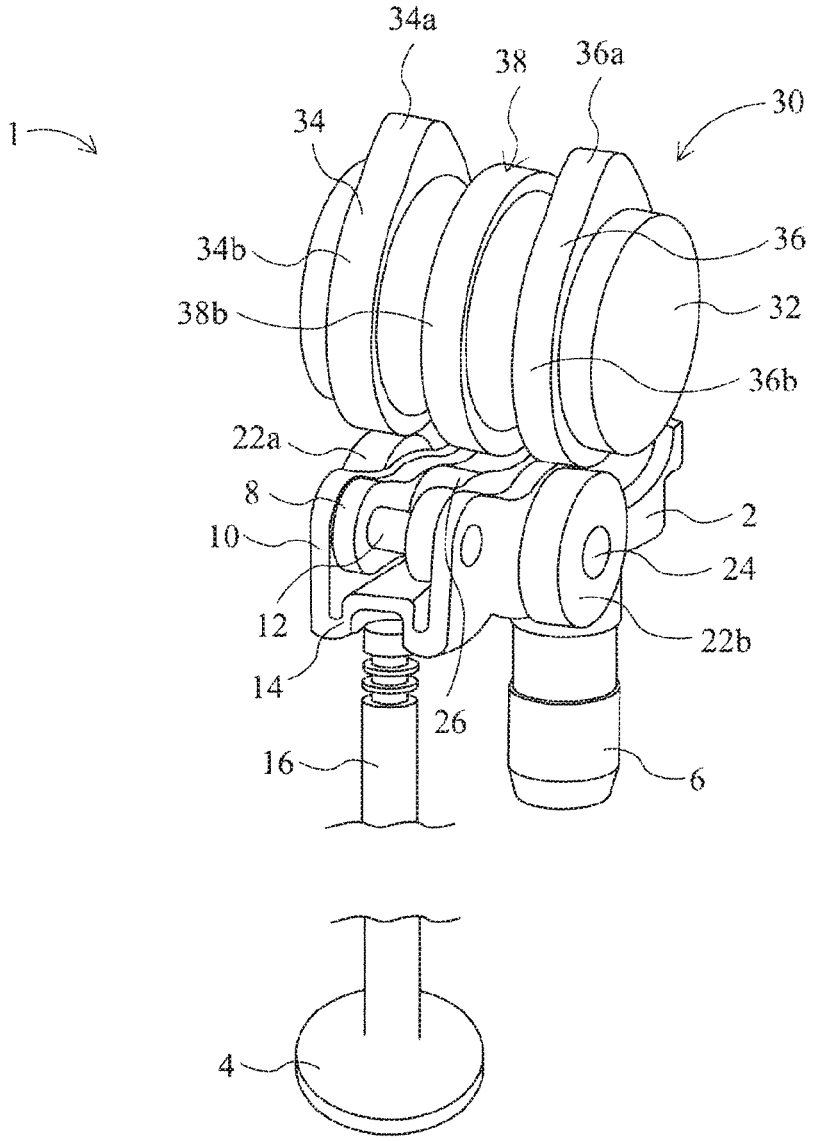
FIG. 1 illustrates a schematic perspective view of a valve train assembly including a dual lift rocker arm.
Figure 2:
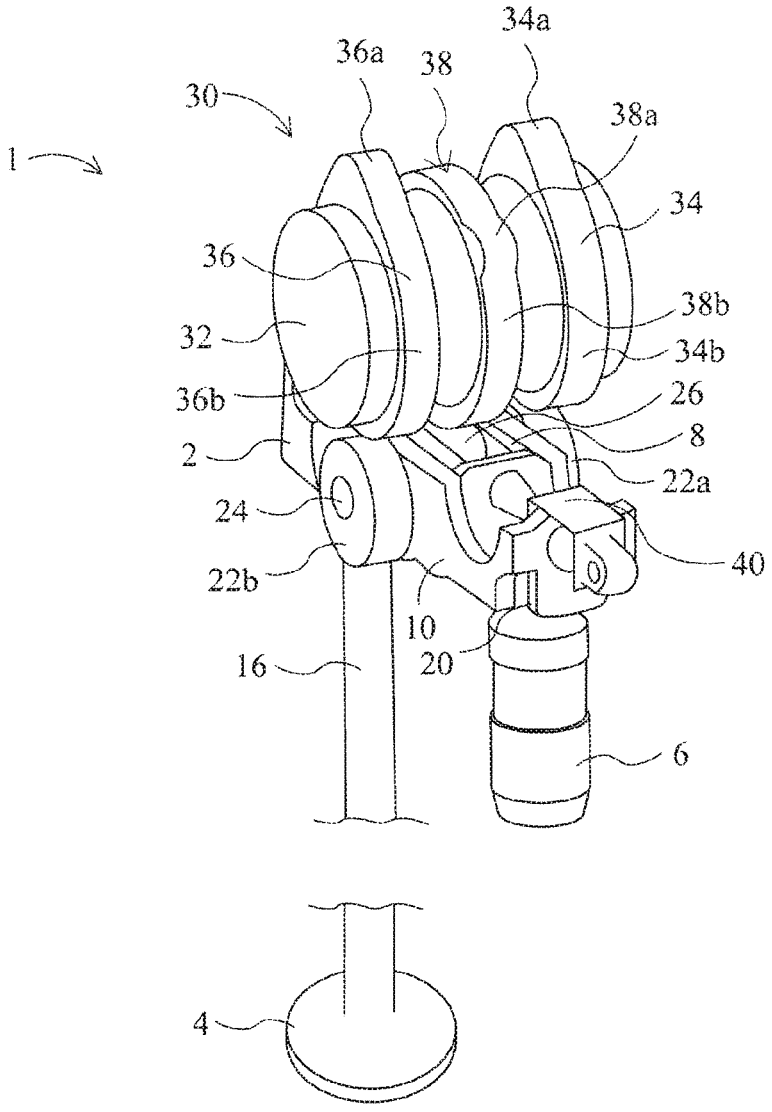
FIG. 2 illustrates another perspective view of the valve train assembly.

Referring first to FIGS. 1 and 2, a valve train assembly 1 comprises a dual lift rocker arm 2, an engine valve 4 for an internal combustion engine cylinder and a lash adjustor 6.

The rocker arm 2 comprises an inner body or arm 8 and an outer body or arm 10. The inner body 8 is pivotally mounted on a shaft 12 which serves to link the inner body 8 and outer body 10 together. A first end 14 of the outer body 10 engages the stem 16 of the valve 4 and at a second end 20 the outer body 10 is mounted for pivotal movement on the lash adjustor 6 which is supported in an engine block. The lash adjuster 6, which may for example be a hydraulic lash adjuster, is used to accommodate slack between components in the valve train assembly 1. Lash adjusters are well known per se and so the lash adjuster 6 will not be described in detail.

The rocker arm 2 is provided with a pair of main lift rollers 22*a* and 22*b* rotatably mounted on an axle 24 carried by the outer body 10. One of the main lift rollers 22*a* is located one side of the outer body 10 and the other of the main lift rollers 22*b* is located the other side of the outer body 10. The rocker arm 2 is further provided with a secondary lift roller 26, located within the inner body 8 and rotatably mounted on an axle (not visible in FIGS. 1 and 2) carried by the inner body 8.

A three lobed camshaft 30 comprises a rotatable camshaft 32 mounted on which are first 34 and second 36 main lift cams and a secondary lift cam 38. The secondary lift cam 38 is positioned between the two main lift cams 34 and 36. The first main lift cam 34 is for engaging the first main lift roller 22*a*, the second main lift cam 36 is for engaging the second main lift roller 22*b* and the secondary lift cam 38 is for engaging the secondary lift roller 26. The first main lift cam 34 comprises a lift profile (i.e. a lobe) 34*a* and a base circle 34*b*, second main lift cam 36 comprises a lift profile 36*a* and a base circle 36*b* and the secondary lift cam 38 comprises a lift profile 38*a* and a base circle 38*b*. The lift profiles 34*a* and 36*a* are substantially of the same dimensions as each other and are angularly aligned. The lift profile 38*a* is smaller than the lift profiles 34*a* (both in terms of the height of its peak and in terms of the length of its base) and is angularly offset from them.

The rocker arm 2 is switchable between a dual lift mode which provides two operations of the valve 4 (a valve operation is an opening and corresponding closing of the valve) per engine cycle (e.g. full rotation of the cam shaft 32) and a single lift mode which provides a single operation of the valve 4 per engine cycle. In the dual lift mode, the inner body 8 and the outer body 10 are latched together by a latching arrangement 40 (see FIG. 2) and hence act as a single solid body. With this particular arrangement, the dual lift mode provides a higher main valve lift and a smaller secondary valve lift per engine cycle. The single lift mode provides just the main valve lift per engine cycle.

During engine operation in the dual lift mode, as the cam shaft 32 rotates, the first main lift cam's lift profile 34*a* engages the first main lift roller 22*a* whilst, simultaneously, the second main lift cam's lift profile 36*a* engages the second main lift roller 22*b* and together they exert a force that causes the outer body 10 to pivot about the lash adjuster 6 to lift the valve stem 16 (i.e. move it downwards in the sense of the page) against the force of a valve spring thus opening the valve 4. As the peaks of the lift profiles 34*a* and 36*a* respectively pass out of engagement with the first main lift roller 22*a* and the second main lift roller 22*b*, the valve spring begins to close the valve 4 (i.e. the valve stem 16 is moved upwards in the sense of the page). When the first main lift cam's base circle 34*b* again engages the first main lift roller 22*a* and the second main lift cam's 36 lift profile engages the second main lift roller 22*b* the valve is fully closed and the main valve lift event is complete.

As the camshaft 32 continues to rotate, then, the secondary lift cam's lift profile 38*a* engages the secondary lift roller 26 exerting a force on the inner body 8 which force, as the inner body 8 and the outer body 10 are latched together, is transmitted to the outer body 10 causing the outer body 10 to pivot about the lash adjuster 6 to lift the valve stem 16 against the force of a valve spring thus opening the valve 4 a second time during the engine cycle. As the peak of the lift profile 38*a* passes out of engagement with the secondary lift roller 26 the valve spring begins to close the valve 4 again. When the secondary lift cam's base circle 38*b* again engages the secondary lift roller 26 the valve 4 is fully closed and the second valve lift event for the current engine cycle is complete.

The lift profile 38*a* is shallower and narrower than are the lift profiles 34*a* and 36*a* and so consequently the second valve lift event is lower and of a shorter duration than is the first valve lift event.

In the single lift mode the inner body 8 and the outer body 10 are not latched together by the latching arrangement 40 and hence in this mode, the inner body 8 is free to pivot with respect to the outer body 10 about the shaft 12. During engine operation in the single lift mode, as the cam shaft 32 rotates, when the first main lift cam's lift profile 34*a* engages the first main lift roller 22*a* and the second main lift cam's lift profile 36*a* engages the second main lift roller 22*b*, the outer body 10 pivots about the lash adjuster 6 and, in an identical way as in the dual lift mode, a main valve lift event occurs. As the camshaft 32 continues to rotate, then, the secondary lift cam's lift profile 38*a* engages the secondary lift roller 26 exerting a force on the inner body 8. In the single lift mode, however, as the inner body 8 and the outer body 10 are not latched together, this force is not transmitted to the outer body 10 which hence does not pivot about the lash adjuster 6 and so there is no additional valve event during the engine cycle. Instead, as the secondary lift cam's lift profile 38*a* engages the secondary lift roller 26, the inner body 8 pivots with respect to the inner body 10 about the shaft 12 accommodating the motion that otherwise would be transferred to the outer body 10. A torsional lost motion spring is provided to return the inner body 8 to its starting position relative to the outer body 10, once the peak of the lift profile 38*a* has passed out of engagement with the secondary lift roller 26.

In one embodiment, this arrangement may be used to provide switchable Internal Exhaust Gas Recirculation (IEGR) control. For example, if the valve 4 is an exhaust valve for an engine cylinder, the main valve lift acts as the main exhaust lift of an engine cycle, and the timing of the secondary valve lift may be arranged so that it occurs when an intake valve for that cylinder, controlled by a further rocker arm mounted pivotally on a further lash adjuster and which pivots in response to an intake cam mounted on the cam shaft 32, is open. The simultaneous opening of the intake and exhaust valves in this way ensures that a certain amount of exhaust gas remains in the cylinder during combustion which, as is well known, reduces NOx emissions. Switching to the single lift mode deactivates the IEGR function, which deactivation may be desirable under certain engine operating conditions. As will be appreciated by those skilled in the art, this switchable IEGR control may also be provided if the valve 4 is an intake valve with the timing of the secondary valve lift arranged to occur when an exhaust valve for that cylinder is open during the exhaust part of an engine cycle.

Figure 3A:
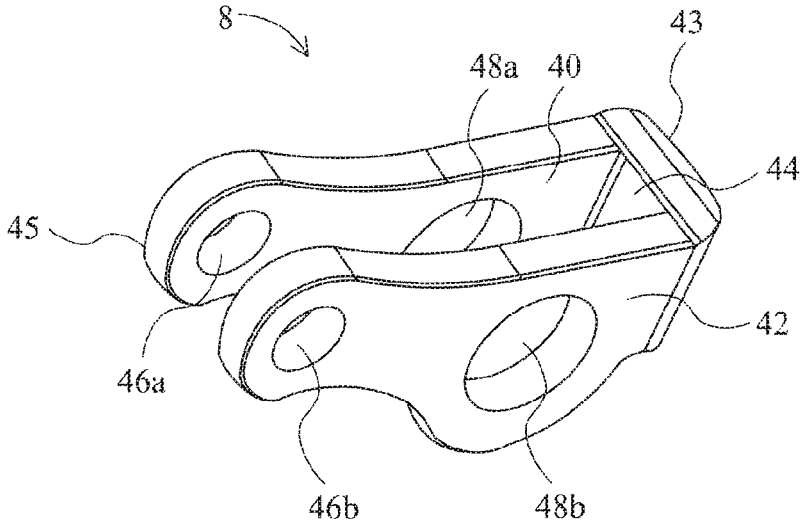
FIG. 3*a* illustrates a perspective view of an inner body of the dual lift rocker arm.
Figure 3B:
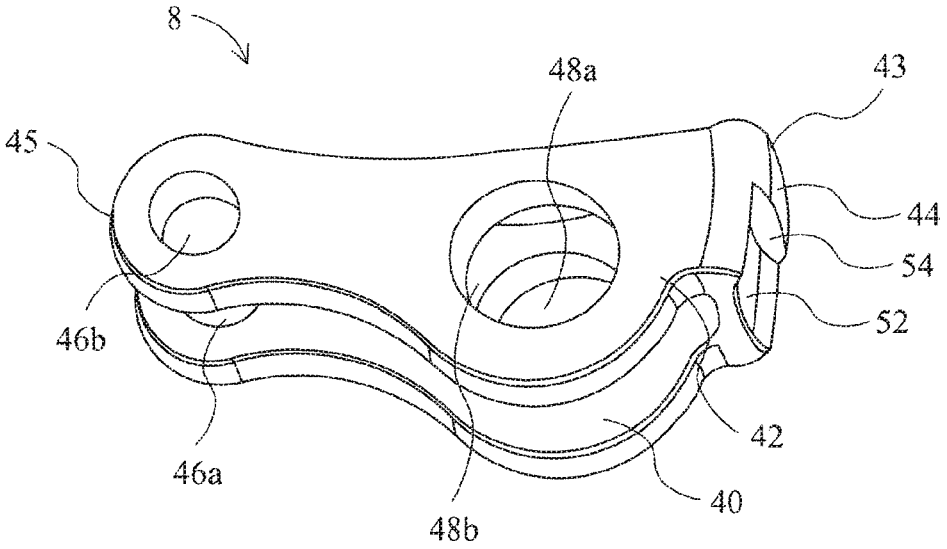
FIG. 3*b* illustrates another perspective view of the inner body.

FIGS. 3*a* and 3*b* illustrate the inner body 8 which comprises parallel first 40 and second 42 side walls and, at a first end 43, an end wall 44 connecting the first 40 and second 42 side walls. Towards a second end 45 of the inner body 8, each of the first 40 and second 42 side walls defines a respective one of a first pair of holes 46*a*, 46*b* which receive the shaft 12. Towards the first end 43, each of the first 40 and second 42 side walls defines a respective one of a second pair of larger diameter holes 48*a*, 48*b* which receive an axle 43 (See FIG. 5) on which the secondary lift roller 26 is mounted. An outer face of the end wall 44 has a recessed portion 52 partly defined by a downward facing latch contact surface 54 for engaging the latching mechanism 40 when in the dual lift mode.

Figure 4A:
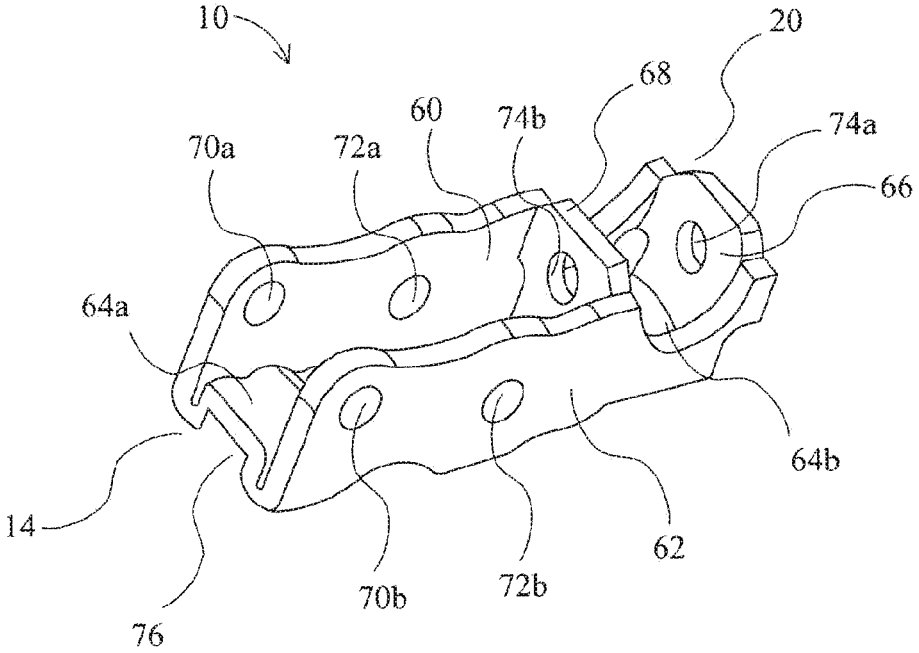
FIG. 4*a* illustrates a perspective view of an outer body of the dual lift rocker arm.
Figure 4B:
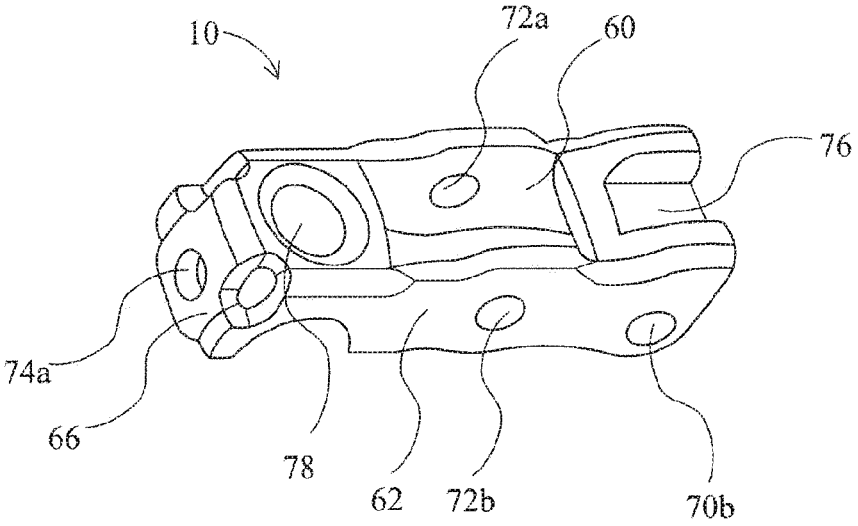
FIG. 4*b* illustrates another perspective view of the outer body.

FIGS. 4*a* and 4*b* illustrate the outer body 10 which comprises parallel first 60 and second 62 side walls, a first base portion 64*a* at the first end 14, a second base portion 64*b* at the second end 20, an end wall 66, at the second end 20, connecting the first 60 and second 62 side walls, and an interior wall 68 which also connects the first 60 and second 62 side walls and is parallel with the end wall 66. Towards the first end 14 of the outer body 10, each of the first 60 and second 62 side walls defines a respective one of a first pair of holes 70*a*, 70*b* which receive the shaft 12. Part way between the first end 14 and the second end 20, each of the first 60 and second 62 side walls defines a respective one of a second pair of holes 72*a*, 72*b* which receive the axle 24. The end wall 66 and the interior wall 68 each respectively define one of a third pair of holes 74*a*, 74*b* for receiving and guiding a latch pin 80 (see FIG. 5).

The first base portion 64*a* defines a recess 76 for engaging the end of the valve stem 16 and the second base portion 64*b* defines a part spherical recess 78 to permit pivoting about a part spherical end of the lash adjuster 6.

Advantageously, as the rocker arm 2 incorporates three roller contacts for the camshaft 30 and no slider contacts, the outer body 10 and the inner body 8 may be manufactured from stamped sheet metal. The latch contact surface 54 may be formed in the inner body 8 by stamping (shearing) using a suitable stamping tool. The use of stamped sheet metal provides for a cost effective manufacturing process. The roller contacts also provide relatively low friction contacts with the cams without the need for low friction coatings.

Figure 5:
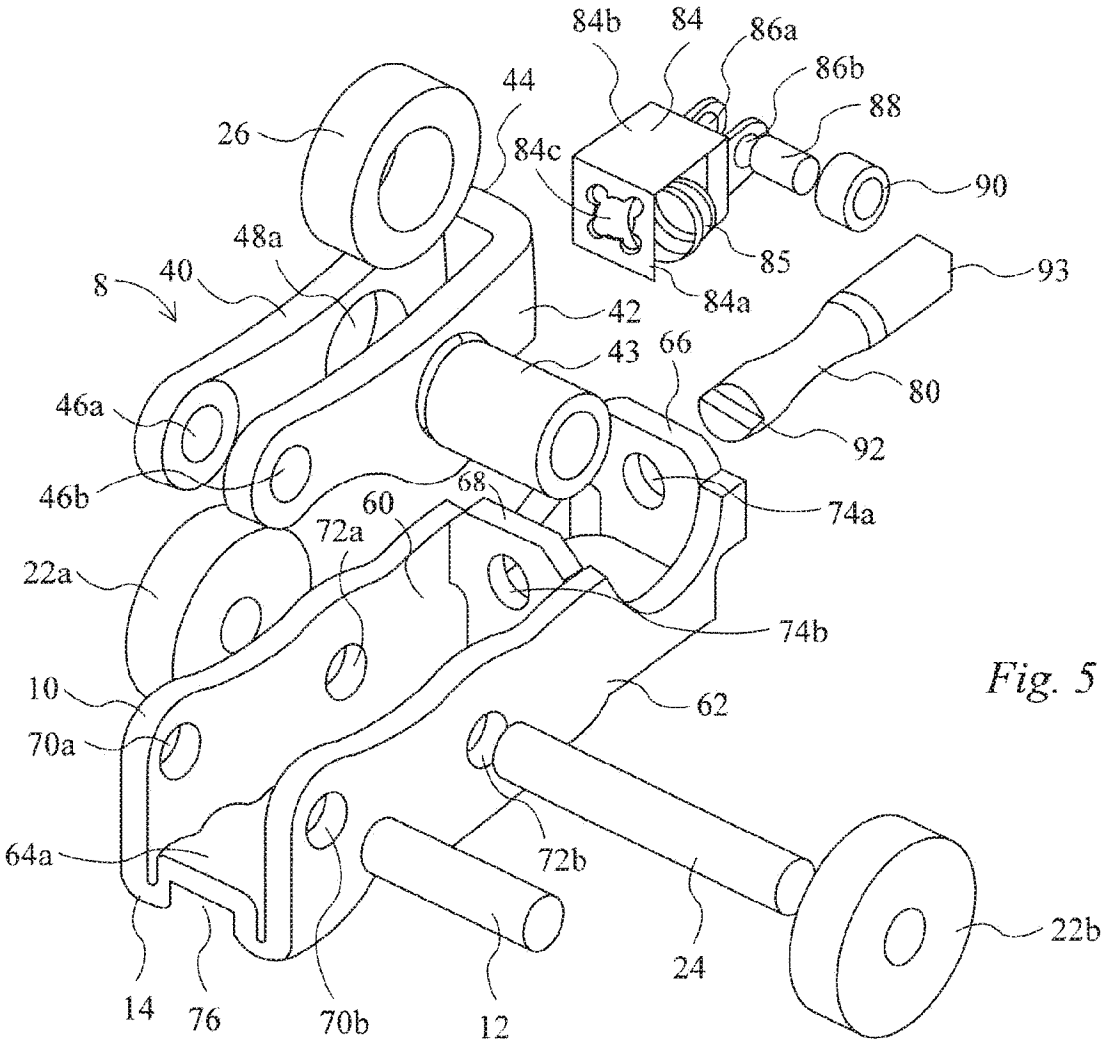
FIG. 5 is an exploded view of the dual lift rocker arm.

As is best understood from FIG. 5, the secondary lift roller 26 is mounted on a hollow inner bushing/axle 43 which is supported in the apertures 48*a* and 48*b*. The axle 24 extends through the inner bushing/axle 43 (and hence through the inner roller 26) and the diameter of the axle 24 is somewhat smaller than the inner diameter of the inner bushing/axle 43 to allow movement of the assembly of the inner body 8, axle 43 and inner roller 26 relative to the outer body 10. The main lift rollers 22*a* and 22*b* are therefore arranged along a common longitudinal axis and the secondary lift roller 26 is arranged along a longitudinal axis that is slightly offset from this. This arrangement of axles and rollers ensures that the rocker 2 arm is compact and facilitates manufacturing the first 10 and second bodies from stamped metal sheets.

As is also best seen from FIG. 5, the latching arrangement 40 comprises the latch pin 80 and an actuation member 84. The actuation member 84 comprises a sheet bent along its width to form first 84*a* and second 84*b* rectangular portions which define a right angle. The first portion 84*a* defines a hole 84*c*. The actuation member 82 further comprises a pair of winged portions extending rearwardly from the second portion 84*c* each of which defines a respective one of a pair of apertures 86*a*, 86*b* for supporting a shaft 88 on which is mounted a roller 90. The actuation member 84 straddles the end wall 66 of the outer body 10 with the second portion 84*c* slidably supported on the end wall 66 with the first portion 84*a* positioned between the end wall 66 and the inner wall 68 of the outer body 10. At one end, the latch pin 80 defines an upward facing latch surface 92.

As seen in FIGS. 6 and 7, the latch pin 80 extends through the holes 74*a* in the end wall 66 and the hole 84*c* in the actuation member 82 and its end 93 engages the wing portions of the actuation member 84.

Figure 6B:
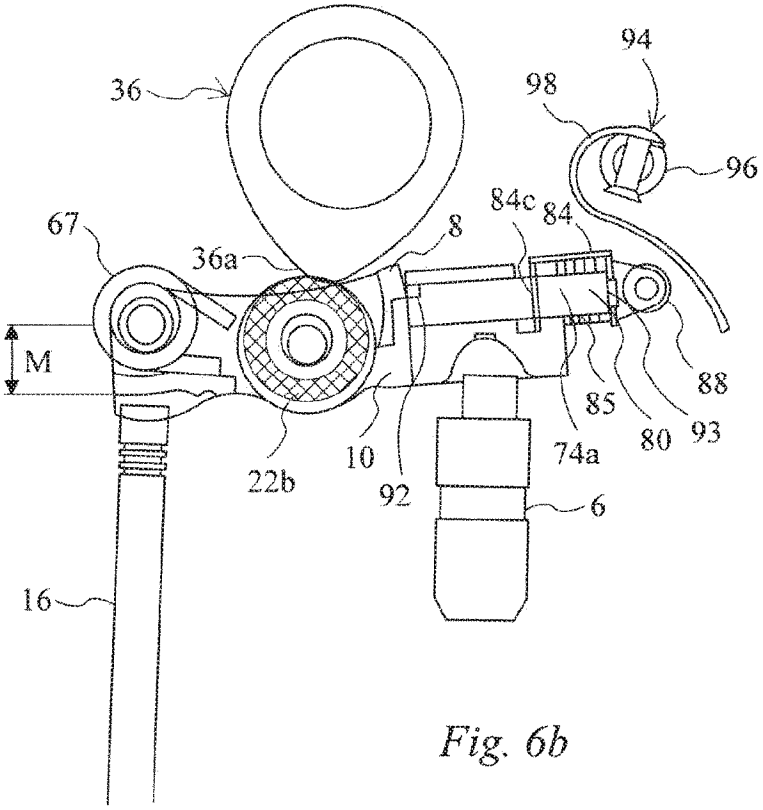
FIGS. 6*a* and 6*b* schematically illustrate the valve train assembly at two different points in engine cycle when the inner and outer bodies are latched.
Figure 6A:
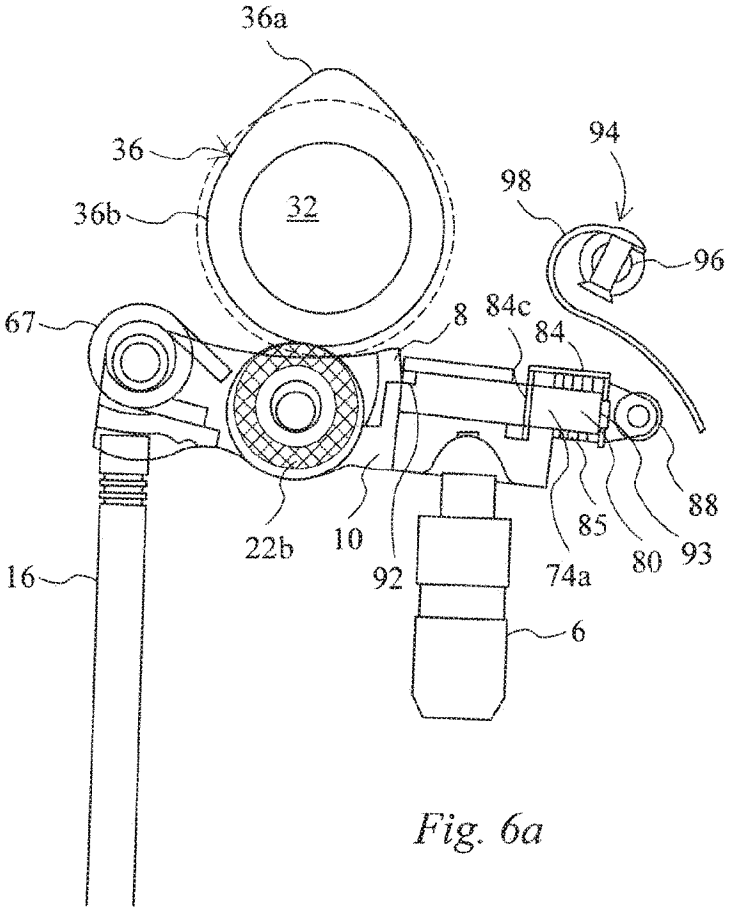

FIGS. 6*a* and 6*b* illustrate the valve train assembly 1 when the rocker arm 2 is in the single lift mode (i.e. unlatched configuration). In this configuration, the actuation member 82 and latch pin 80 are positioned so that the latch surface 92 does not extend through the hole 74*b* and so does not engage the latch contact surface 54 of the inner body 8. In this configuration, the inner body 8 is free to pivot, with respect to the outer body 10, about the shaft 12 when the secondary roller 26 engages the lift profile 38*a* and hence there is no additional valve event. It will be appreciated that the amount of movement available to the inner body 8 relative to the outer body 10 (i.e. the amount of lost motion absorbed by the inner body 8) is defined by the size difference between the diameter of the axle 24 and the inner diameter of the inner bushing/axle 43. The torsional spring 67, which is installed over the top of the valve stem 16 and is located inside the inner body 10 by the shaft 12, acts as a lost motion spring that returns the inner body 8 to its starting position with respect to the outer body 10 after it has pivoted.

Figure 7B:
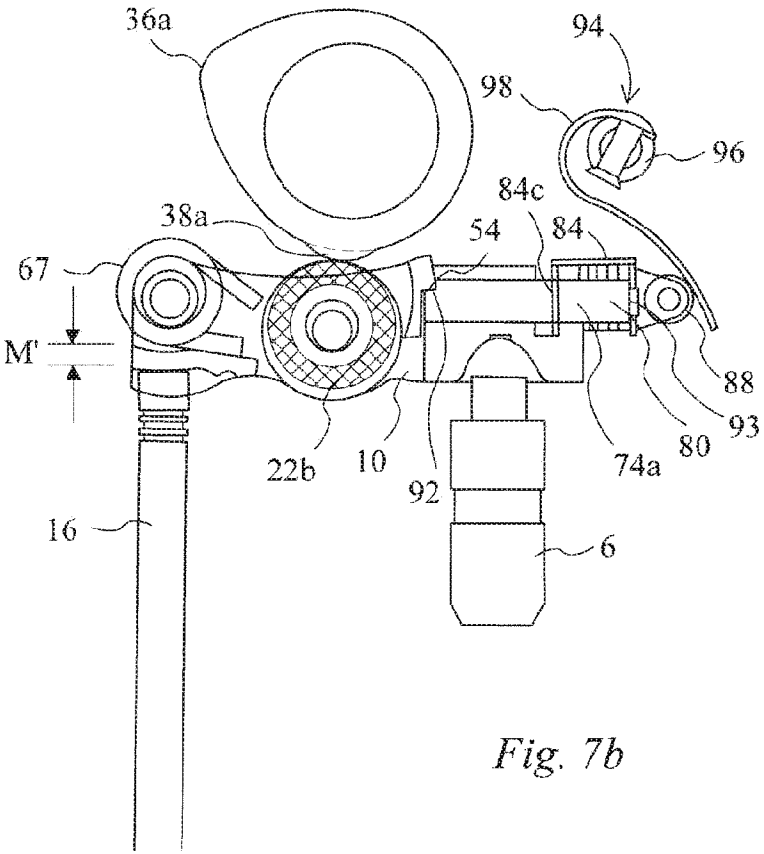
FIGS. 7*a* and 7*b* schematically illustrate the valve train assembly at two different points in engine cycle when the inner and outer bodies are un-latched.
Figure 7A:
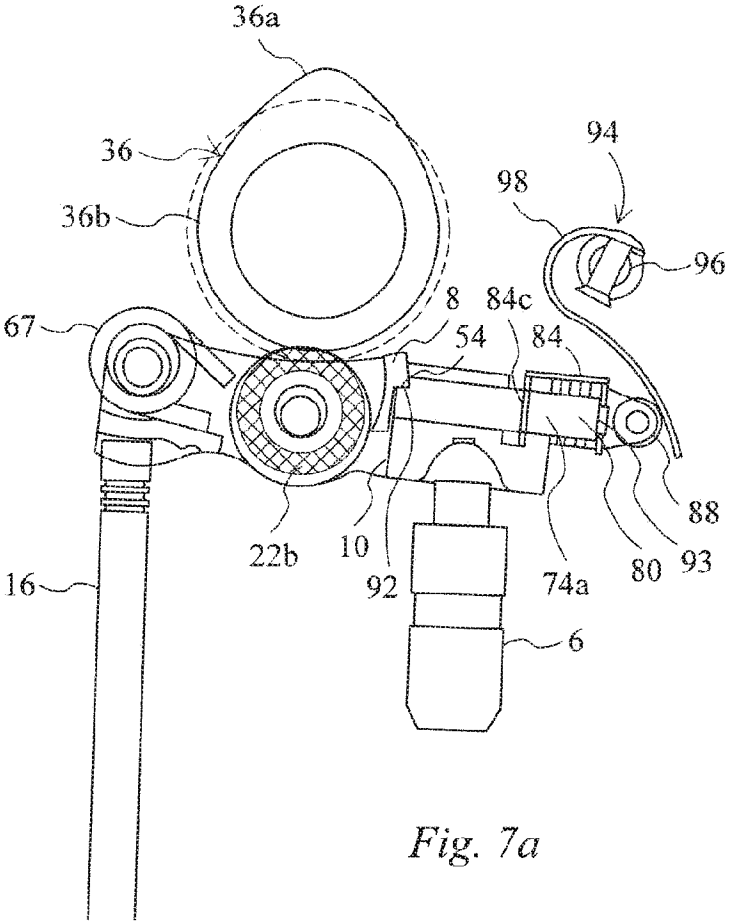

FIGS. 7*a* and 7*b* illustrate the valve train assembly 1 when the rocker arm 2 is in the dual lift mode (i.e. a latched configuration). In this configuration, the actuation member 82 and latch pin 80 are moved forward (i.e. to the left in the Figures) relative to their positions in the unlatched configuration so that the latch surface 92 does extend through the hole 74*b* so as to engage the latch contact surface 54 of the inner body 8. As explained above, in this configuration, the inner body 8 and the outer body 10 act as a solid body so that when the when the secondary roller 26 engages the lift profile 38*a* there is an additional valve event.

An actuator 94 is provided to move the latching arrangement 40 between the un-latched and latched positions. In this example, the actuator comprises an actuator shaft 96 and a biasing means 98, preferably a leaf spring. In the default unlatched configuration, the leaf spring 98 does not engage the latching arrangement 40. To enter the latched configuration, the shaft 96 is rotated a certain amount (for example 12 degrees) causing the leaf spring 98 to engage the roller 88 and to push the latching arrangement 40 into the latched position. A spring 85 mounted over the latch pin 80 and supported between an outer face of the end wall 66 and the winged members of the member 84 is biased to caused the latching arrangement 40 to return to its unlatched position when the actuator shaft 96 is rotated back to its unlatched position and the leaf spring 98 disengages the roller 88.

Other types of actuators for the latching arrangement that may for example make use of pressurised oil, electromechanical systems or pneumatic systems will be known to those skilled in the art.

The actuator shaft 94 may also be used as an oil spray bar that sprays oil to lubricate or cool the valve train components.

Advantageously, when the base circle 38*b* engages the inner bushing/axle 43, the inner bushing axle 43 stops always on the axle 24 which ensures that the orientation of the various components is such that the latch pin 80 is free to move in and out of the latched and unlatched positions.

FIG. 6*a* illustrates the valve train assembly 1 when the rocker arm 2 is in the single lift mode (i.e. the un-latched configuration) at a point in an engine cycle when the main lift rollers 22*a* and 22*b* are engaging the respective base circles 34*b* and 36*b* of the first main lift cam 34 and the second main lift cam 36. At this point in the engine cycle, the valve 4 is closed. FIG. 6*b* illustrates the valve train assembly 1 when the rocker arm 2 is in the single lift mode at another point in an engine cycle when the main lift rollers 22*a* and 22*b* are engaging the respective peaks of the lift profiles 34*a* and 36*a* of the first main lift cam 34 and the second main lift cam 36. At this point in the engine cycle the valve 4 is fully open and the 'maximum lift' of the main valve event is indicated as M.

FIG. 7*a* illustrates the valve train assembly 1 when the rocker arm 2 is in the dual lift mode (i.e. the latched configuration) at a point in an engine cycle when the main lift rollers 22*a* and 22*b* are engaging the respective base circles 34*b* and 36*b* of the first main lift cam 34 and the secondary lift roller 26 is engaging the base circle 38*b* of the secondary lift cam 38. At this point in the engine cycle, the valve 4 is closed. FIG. 7*b* illustrates the valve train assembly 1 when the rocker arm 2 is in the single lift mode at another point in an engine cycle when the main lift rollers 22*a* and 22*b* are engaging the respective base circles 34*b* and 36*b* of the first main lift cam 34 and the second main lift cam 36 and the secondary lift roller 26 is engaging the peak of the lift profile 38*a* of the secondary lift cam 38. At this point in the engine cycle the valve 4 is fully open during the additional valve event and the 'maximum lift' of the secondary valve event is indicated as M'.

Figure 8:
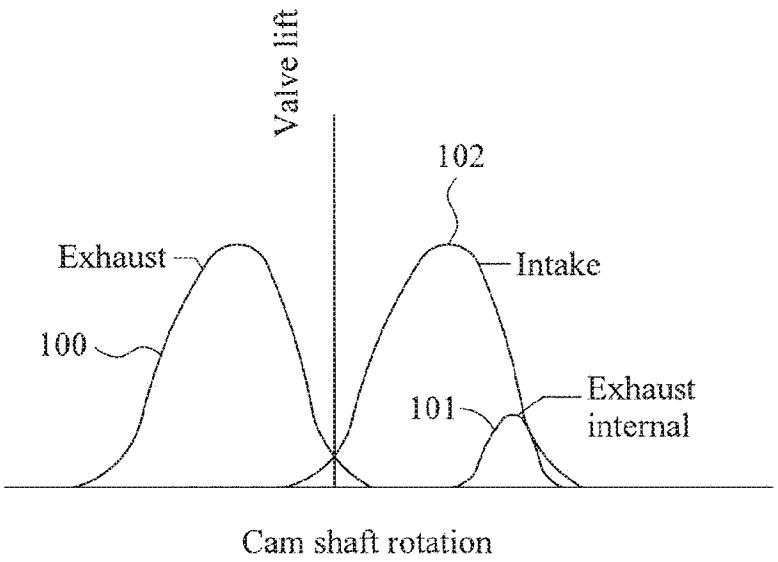
FIG. 8 illustrates a graph showing valve lift against cam shaft rotation.

FIG. 8 illustrates a graph in which the Y axis indicates valve lift and the X axis indicates rotation of the cam shaft. In the example of the valve 4 being an exhaust valve, the curve 100 represents the main lift of the exhaust valve during an engine cycle and the curve represents 101 the additional lift of the exhaust valve during the subsequent engine cycle. The curve 102 represents the lift of intake valve, during the subsequent engine cycle, operated by an intake rocker arm in response to an intake cam mounted on the cam shaft. It can be seen that the cams are arranged so that in any given engine cycle, the additional smaller opening of the exhaust valve occurs when the intake valve is open to thereby provide a degree of internal exhaust gas recirculation.

As previously mentioned, in an alternative arrangement (not illustrated) the valve 4 is an intake valve rather than an exhaust valve (making the rocker arm 2 an intake rocker arm) and an exhaust rocker arm operates an exhaust valve in response to an exhaust cam mounted on the cam shaft. In this alternative arrangement the cams are arranged so that in any given engine cycle, the additional smaller opening of the intake valve occurs when the exhaust valve is open to thereby provide a degree of internal exhaust gas recirculation.

The above embodiment is to be understood as an illustrative example of the invention only. Further embodiments of the invention are envisaged. For example, in an alternative embodiment the inner body 8 is permanently fixed with respect to the outer body 10 such that there is only one mode of operation in which the main and secondary valve lifts occur in every engine cycle. Although in the described embodiment, in one mode of operation, there are two different valve lifts per engine cycle (a high lift at one point in the cycle and a low lift in another part of the cycle) the rocker arm may be arranged to provide alternative types of dual mode operation, for example, a first mode in which there is a single type of valve lift (e.g. a high lift) per engine cycle and a second mode in which there is a different single type of valve lift (e.g. a lower lift) per engine cycle. The different lifts may be at the same point or at different points in the engine cycle. Accordingly, although in the described embodiment the valve train 1 is arranged so that the additional lift provides for IEGR, it is to be understood that this is only a preferred example of a use of an embodiment of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A valve train assembly comprising:

a rocker arm comprising:

a first body supporting a first axle on which is mounted a first roller configured to engage a first rotatable cam surface, wherein at least part of the rocker arm can be pivoted by at least the first rotatable cam surface to move a valve to cause a first valve event;

a second body supporting a second axle on which is mounted a further roller configured to engage a further rotatable cam surface, wherein at least part of the rocker arm can be pivoted by the further rotatable cam surface to move the valve to cause a second valve event, wherein one of the first and second bodies is pivotally mounted with respect to the other of the first and second bodies;

wherein the rocker arm is configurable in a first mode of operation in which one of the first and second valve events occurs and a second mode of operation in which both the first and second valve events occur or the other of the first and second valve events occurs;

wherein the rocker arm further comprises a latch configured to latch and unlatch the first and second bodies together and wherein which of the first and second modes the rocker arm is configured in depends upon whether the first and second bodies are latched or are unlatched;

wherein the latch comprises a latch member moveable between a latched position whereby the latch member latches the first and second bodies together and an unlatched position in which the first and second bodies are unlatched; and wherein the valve train assembly further comprises a latching actuator configured to move the latch member between the latched position and the unlatched position, wherein the latching actuator comprises a rotatable shaft attached to a biasing member, wherein rotating the rotatable shaft from a first position to a second position causes the biasing member to move the latch member between the latched position and the unlatched position.

2. The valve train assembly according to claim 1, wherein the latch member is a latch pin comprising a latch surface configured to engage one or other of the first and second bodies to prevent relative pivotal movement of the first and second bodies.

3. The valve train assembly according to claim 2, wherein at least one of the first body and second bodies defines a guide hole for guiding the latch pin when the latch pin moves between the latched and unlatched positions.

4. The valve train assembly according to claim 1, wherein the rotatable shaft functions as an oil spray bar.

5. The valve train assembly according to claim 1, wherein a second roller is mounted on the first axle for engaging a second rotatable cam surface, wherein at least part of the rocker arm can be pivoted by the first rotatable cam surface acting on the first roller and the second rotatable cam surface acting on the second roller to move the valve to cause the first valve event.

6. The valve train assembly according to claim 5, wherein one of the first and second axles defines an aperture and the other of the first and second axles extends through the aperture.

7. The valve train assembly according to claim 1, wherein when the first and second bodies are unlatched the rocker arm is in the first mode of operation and when the further roller engages a lobe of the further rotatable cam surface, the second body pivots with respect to the first body so that the first body is prevented from causing the second valve event.

8. The valve train assembly according to claim 1, wherein one of the first and second bodies is mounted within the other of the first and second bodies.

9. The valve train assembly according claim 1, wherein one or both of the first and second bodies are comprised of a stamped metal sheet.

10. The valve train assembly according to claim 1, further comprising a cam shaft having the first cam surface and the further cam surface.

11. The valve train assembly according to claim 1, wherein one or both of a) one of the first and second valve events is of a longer duration than the other of the valve events, and b) one of the first and second valve events is of a higher lift than the other of the valve events.

12. The valve train assembly according to claim 1, wherein the valve is an exhaust valve or an intake valve for an engine cylinder and wherein the first valve event is a main lift of the valve and the second valve event is a secondary lift of the valve arranged to enable exhaust gas recirculation.

* * * * *